United States Patent [19]

Beitzinger

[11] Patent Number: 4,760,688

[45] Date of Patent: Aug. 2, 1988

[54] OPEN-END SPINNING MACHINE WITH PLURAL SPINNING STATIONS AND THREAD JOINING PROCESS THEREFOR

[75] Inventor: Kurt Beitzinger, Ingolstadt, Fed. Rep. of Germany

[73] Assignee: Schubert & Salzer Maschinenfabrik, Ingolstadt, Fed. Rep. of Germany

[21] Appl. No.: 897,782

[22] PCT Filed: Dec. 20, 1985

[86] PCT No.: PCT/DE85/00548

§ 371 Date: Jul. 31, 1986

§ 102(e) Date: Jul. 31, 1986

[87] PCT Pub. No.: WO86/03792

PCT Pub. Date: Jul. 3, 1986

[30] Foreign Application Priority Data

Dec. 24, 1984 [DE] Fed. Rep. of Germany ..... 3447428

[51] Int. Cl.[4] ..... D01H 1/26; D01H 15/02

[52] U.S. Cl. ..... 57/92; 57/263; 57/406

[58] Field of Search ..... 57/92, 93, 104, 261, 57/263, 406

[56] References Cited

U.S. PATENT DOCUMENTS

| | | | |
|---|---|---|---|
| 3,693,340 | 9/1972 | Kanai et al. | 57/93 |
| 3,704,579 | 12/1972 | Tooka et al. | 57/93 X |
| 3,780,513 | 12/1973 | Watanabe et al. | 57/93 |
| 3,791,128 | 2/1974 | Landwehrkamp | 57/93 |
| 3,807,157 | 4/1974 | Stahlecker | 57/92 X |
| 3,810,352 | 5/1974 | Miyazaki et al. | 57/263 X |
| 4,059,946 | 11/1977 | Buttcher et al. | 57/93 X |
| 4,163,359 | 8/1979 | Honjo | 57/93 |
| 4,249,369 | 2/1981 | Tsuzuki et al. | 57/93 X |
| 4,266,397 | 5/1981 | Donmez et al. | 57/93 X |
| 4,276,741 | 7/1981 | Stahlecker et al. | 57/263 |
| 4,408,447 | 10/1983 | Sloupensky et al. | 57/263 |

FOREIGN PATENT DOCUMENTS

| | | |
|---|---|---|
| 2610575 | 9/1977 | Fed. Rep. of Germany . |
| 2754785 | 7/1978 | Fed. Rep. of Germany . |
| 2910814 | 10/1980 | Fed. Rep. of Germany . |
| 2149557 | 3/1973 | France . |
| 59-21966 | 5/1984 | Japan . |

*Primary Examiner*—Donald Watkins
*Attorney, Agent, or Firm*—Dority & Manning

[57] ABSTRACT

In an open-end spinning machine, a centralized main drive is provided to collectively drive spinning elements of a plurality of spinning stations installed next to each other. At each spinning station, a switch-over device is provided for switching each spinning station over to a stationary, centralized auxiliary drive. The main drive includes a main drive belt to collectively drive the plurality of spinning elements. An auxiliary drive belt driven at a second speed for selectively driving individual spinning units is powered by the stationary centralized auxiliary drive. Using its respective switch-over device, either the main drive belt or the auxiliary drive belt can be selected to drive a given spinning unit. Thread joining preferably takes place at a spinning unit (e.g. spinning rotor) speed relatively close to the production speed of the spinning unit so that strong thread joins and consistent thread results.

45 Claims, 9 Drawing Sheets

OPEN-END SPINNING MACHINE WITH PLURAL SPINNING STATIONS AND THREAD JOINING PROCESS THEREFOR

BACKGROUND AND SUMMARY OF THE INVENTION

The instant invention concerns an open-end spinning machine with a plurality of spinning stations located next to each other, having spinning elements driven collectively by a collective drive, and a process for thread joining on such a machine. In a known process, thread joining is carried out at reduced rotor speed, whereby the speed of fiber feeding and thread drawoff is adapted to this reduced number of RPMs of the rotor in such a way that the rotor speed ratio between the individual spinning elements is maintained at all times as it was preset for spinning production (German Pat. DE-OS No. 2,058,604, corresponding with U.S. Pat. No. 3,791,128). In order to attain this reduced rotor speed for thread joining at an individual spinning station in a simple manner when a plurality of spinning stations are driven collectively, the RPM's of the spinning rotor are scanned during run-up to production speed, and the thread joining process is started when the reduced number of RPMs is reached (German Pat. DE-AS No. 2,341,528, corresponding with U.S. Pat. No. 4,276,741 and DE-OS No. 2,610,575). However, the time available here and also the number of RPMs are not constant and vary in particular depending upon the running condition of the machine and of the individual rotor bearings. This not only influences the success of thread joining but also the speed and the quality of the joints.

Another known method consists in providing a step-up gearing between a drive belt and the rotor shaft for each spinning station and to preset two step-up ratios which can take over the driving of the spinning rotor alternately for thread joining or for production, as desired (German Pat. DE-OS No. 2,754,785, Japanese Pat. JP-PS-AS No. 21.966/84. Although rotor speed is thus reduced by a certain percentage for thread joining, this speed is always in a fixed relation to the production speed of the rotor. Thus the rotor speed for thread joining is different from and dependent from production speed.

The instant invention is based upon the surprising finding that the rotor speed for thread joining should not always be uniformly low, and should not always be reduced at a fixed ratio to the production speed of the rotor. The correct rotor speed for thread joining depends in each case upon the fiber material to be spun.

It is therefore the objective of the instant invention to avoid the disadvantages cited above. In particular, it is the objective of the instant invention to create a simple device by means of which a second rotor speed can be attained individually at a spinning station whereby it is possible to select said rotor speed in a simple manner in accordance to spinning conditions, and independently from the production rotor speed.

It is a further objective of the instant invention to create a thread joining process which improves successful piecing and the quality of the joints.

This objective is attained by the invention by providing, in addition to the collective drive, a stationary auxiliary drive which can be attributed to (i.e. associated with) the spinning element of each spinning station individually, instead of the collective drive. The speed of this second, stationary auxiliary drive which can be individually attributed to the spinning elements can be adapted as needed to any given fiber material, rotor diameter, etc. at a central location. Since this adjustment is carried out once per machine or per section, such an adaptation to a different type of fibers is economical from the standpoint of both time and material. The auxiliary drive is preferably located in the end frame of the machine.

The concept of "spinning element", in the sense of the instant invention, shall include all elements required for the spinning process. This is preferably a spinning rotor, but this concept should also comprise, in addition to a spinning rotor, a pair of friction rollers as well as other elements of a spinning station, for example the feed roller, etc.

According to a preferred embodiment of the object of the invention, the auxiliary drive is equipped with a drive motor that is separate from the collective drive. In this way the speed ratio between the two drives can be controlled very simply.

In an alternate embodiment of the invention however, a single drive motor can be provided also and can be attributed to the collective drive directly and to the auxiliary drive via a step-up gear.

In the sense of the invention the concept "step-up gear" is to be understood to mean a gear to step up speed, as well as to reduce speed.

The step-up ratio of the step-up gear can be set as a function of production speed and of the material to be spun, preferably between 95:100 and 75:100, so that the rotation speed of the spinning elements is merely in about the range of and 5% to 25% lower for thread joining than for production.

In many applications a gradual acceleration of the spinning aggregate from thread joining speed to production speed is not required. According to an aspect of this invention, the step-up gear (if present) is preferably equipped with a stepped speed pulley for such case.

The adjustment of the step-up gear is preferably continuous, and a further advantage is achieved if the speed of the auxiliary drive can be increased to the speed of the collective drive.

Experience has shown that even when the fiber feeding device suddenly releases the fiber tuft, the fibers do not reach the spinning element jerkily but that the fiber quantity reaching the spinning element increases according to a run-up curve until finally the fiber quantity per time unit coming into the spinning element is steadily as preset by the feeding speed of the fiber feeding device. Therefore it is preferable to accelerate the auxiliary drive not randomly but according to this run-up curve of the fiber quantity reaching the spinning element upon release of the fiber feeding device.

It is also useful for many purposes if the direction of rotation of the auxiliary drive can be reversed. This applies especially to the friction rollers and the feed roller.

Preferably the auxiliary drive is controlled through controls located on a service unit travelling alongside a plurality of spinning stations, whereby the entire thread joining process is controlled through said controls. In a preferred embodiment of the invention the controls on the service unit which control the auxiliary drive are also controllably linked to an auxiliary driving device for the mechanism which draws off the thread during the thread joining process. In this way, the thread drawoff speed can be adjusted to the rotational speed of the spinning element and to the thread joining process. At the same time it is absolutely possible to control the thread draw-off speed asynchronously to the rotational speed of the spinning element, for example in order to give the thread temporarily greater twist for the thread joining process.

According to a preferred embodiment of the invention, the collective drive is equipped with a main drive belt to drive a plurality of spinning elements simultaneously and the auxiliary drive is equipped with an auxiliary drive belt to drive a spinning element individually. The main drive belt drives all normally operating spinning elements at the same speed during production. By contrast, spinning elements in which a thread is to be joined anew are separated from this main drive belt during the thread joining phase and are instead driven individually by the auxiliary drive belt which, in turn, is driven at a speed different from that of the main drive belt. Thus any spinning element at which a thread is to be joined is operating at a rotational speed different from that of the spinning elements operating undisturbed at production speed.

For reason of material and space savings, the auxiliary drive belt can be made narrower than the main drive belt. Since the auxiliary drive belt only drives one single spinning element at a time, functional reliability is nevertheless ensured.

The selection of the desired drive, in each case, for a specific spinning element is made preferably by means of an individual switch-over device which alternately attributes (i.e. drivingly couples) one of the two drives to the spinning element. This switch-over device can be borne upon by an elastic element so that the main drive belt can be brought to bear against a drive element connected to and rotating with the spinning element, or can be held against said drive element when the switch-over device is enabled (i.e. released).

Preferably a two-armed switch-over lever is provided for each spinning station. This lever is equipped with a main contact roller on one arm and with an auxiliary contact roller on the other arm for the alternate application of the main drive belt or of the auxiliary drive belt against the spinning element. In this manner a simple embodiment in accordance with the object of this invention is achieved.

In order to avoid additional operating elements per spinning station, the switch-over is preferably linked in a controllable manner to a brake for the spinning element. This controllable linking can be achieved in various ways. In a preferred embodiment of the device according to invention the brake is attributed to (i.e. comprised of) a brake lever supported by the switch-over lever.

Simple control of the spinning element brake and of the switch-over device is achieved according to this invention by equipping the brake lever with at least one carrier, and through the fact that said brake lever, by moving from a neutral spinning position into its first end position constituting the braking position, lifts the main contact roller from the main drive belt and, by moving into its other end position constituting the thread joining position, causes the auxiliary contact roller to be applied against the auxiliary drive belt.

According to a preferred embodiment according to the object of this invention, the brake lever is pivotably supported on bearings by its one end on the main drive roller supporting shaft of the two-armed lever, is at the same time linked to an activating device by its free end, and is equipped with a braking surface between its two ends. It can be moved into its braking position so that the brake lever, after reaching its braking position and continuing its movement, causes pivoting of the switch-over lever as a result of the application of its braking surface against the spinning element.

It is advantageous if the spinning element is located in immediate proximity of the main contact roller, and further if the distance between the free end of the brake lever (used and for activation) and the brake (which can be brought to bear upon the spinning element) is greater than the distance between the brake and the bearing shaft.

In a preferred embodiment of a device according to this invention, the brake lever is equipped with an intermediate lever which, together with the switch-over lever, is pivotably supported on bearings on a common shaft. One end of said intermediate lever is in gearing contact with the activating device and overlaps the two-armed lever of the switch-over device on its side opposite to the spinning element. The other end of said intermediate lever is articulatedly linked to the brake lever which reaches under the two-armed switch-over lever on its side towards the spinning element. In this manner, in spite of minimal switching paths, only little switching force is required.

In order to lower the drive forces for activation of the brake and of the switch-over device by properly selecting lever arms and drive moments, and in order to raise operational security the brake lever is preferably supported on bearings independently from the two-armed lever of the switch-over device, whereby the brake lever is equipped with one carrier on each side of the pivoting axis of the two-armed switch-over lever for the pivoting of the two-armed switch-over lever into one or the other pivoting direction, as desired. Because of the independent bearing support of the brake lever its pivoting point can be selected so as to render the brake's movement essentially linear when it is moved into or out of braking position. This increases operational security of the device.

In a further, preferred development of such an embodiment of the invention, the shaft of a spinning element in the form of a spinning rotor is supported on bearings in a wedge-shaped gap formed by supporting rings, while the brake lever can be moved in its braking movement in the direction of said supporting rings. Under such conditions, space utilization is especially good if the shaft of the spinning rotor is supported by a single pair of supporting rings on the side towards the spinning rotor, in relation to the drive belt and the auxiliary drive belt, and is supported by a combined axial/-radial bearing on the side away from the spinning rotor.

In a fully automatic open-end spinning machine, a service unit is normally provided for travelling alongside a plurality of spinning stations, and which can interact as desired with each spinning station. It is advantageous in such instances if the service unit is equipped with a drive device to activate the switch-over device, said drive device being controlled by means of a control program.

The switch-over device is preferably provided at each spinning station with a control lever for attribution (i.e. application) of the collective drive or of the central auxiliary drive, as desired, to a spinning element, said control lever being pivotable in relation to a hinged cover covering the spinning station. This control lever allows for simple control of the device according to this invention, especially when, in further suitable embodiments according to the object of this invention, the control lever is able to assume three relative positions with respect to the cover, whereby it is flush with the cover in its basic position, pivots away from the cover in its braking position, and is pushed into the cover in its thread joining position.

In order to allow for simple manual control of a device according to this invention, a locking device is suitably provided for the control lever. The operator needs both hands to lift off the bobbin, during the thread joining process, for the search and back-feeding of the thread, for the lowering of the bobbin and to enable (or release) fiber feeding. The locking device ensures that the operator does not also have to hold the control lever in its thread joining position during the thread joining process.

If, in further embodiments according the object of this invention, the locking device is subjected to elastic pressure in such way as to permit the movement of the control lever into the thread joining position while preventing its return into the production position, and if the locking device is furthermore equipped with a controllable solenoid, it becomes possible to control the enabling (i.e. releasing) of the control lever, so that it can return into the production position in a simple manner by means of an electric switch. In such case, the switch is preferably the switching device controlling fiber feeding, whereby the solenoid is then controllably linked to this switching device controlling fiber feeding.

To prevent untimely wear of the main contact roller and of its bearing because of possible imbalance in the spinning element, it is useful to equip the switch-over lever with a damping device. The latter is suitably made in the form of a frictional damper located preferably in the bearings of the switch-over lever.

The above-described device in the assembly makes it possible to carry out thread joining in the simplest and optimal manner. It is especially important for uniformity of yarn characteristics to maintain essentially constant rotor speed during the spinning process. Yarn production begins as early as during the thread joining process, and for this reason, according to the instant invention, thread joining is carried out preferably at a rotor speed that is close to the rotor speed for production, whereby the rotor speed for thread joining should be selected as high as possible as a function of the type of fiber material to be spun, of the rotor diameter, etc.

It has been shown here, as a rule, that optimal results are obtained when the RPMs of the rotor for thread joining are 5% to 25% below the RPMs of the rotor during production.

Use of a device provided in accordance with this invention makes it possible to impose a defined thread joining speed for a desired period of time and at the desired moment upon each spinning element in a simple and reliable manner, without requiring a separate drive for the spinning element at each spinning station. Thus a predetermined thread joining program can be used and the reliability of thread joining is considerably increased in comparison with the known state of the art, while joints become cleaner and stronger.

BRIEF DESCRIPTION OF THE DRAWINGS

Several examples of embodiments in accordance with this invention are explained through the specification below, taken in conjunction with the appended drawings, in which.

DETAILED DESCRIPTION OF THE PREFERRED EMBODIMENTS

Figure 1:
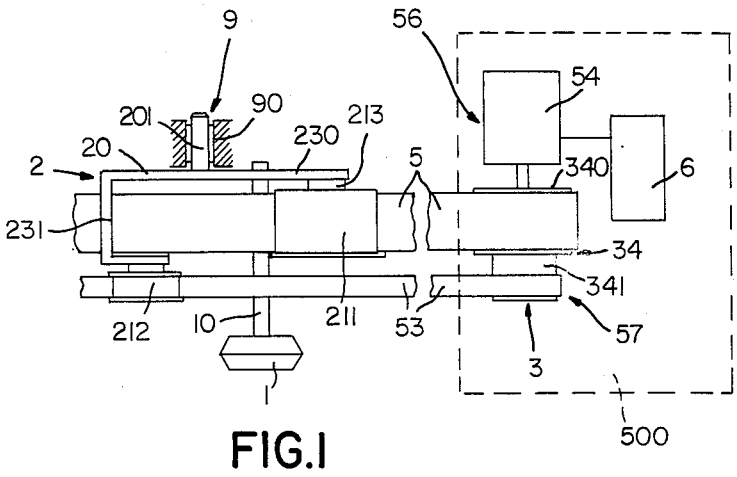
FIG. 1 is a schematic top view of an embodiment of the invention with two drive belts as well as with a switch-over lever to alternately take the drive belt in and out of action.

The invention is at first explained through the example shown in FIG. 1. At each spinning station S a spinning element in form of a spinning rotor 1 is provided. The spinning rotor 1 is supported on bearings by means of a shaft 10 and is driven via said shaft by means of a main drive belt 5. This main drive belt 5 is a component of a collective drive 56 by which the spinning rotors 1 of a plurality of spinning stations S located next to each other are driven via said main drive belt 5 simultaneously with the spinning rotor 1 of the shown spinning station S. The main drive belt 5 is itself driven by a main motor 54 in the machine drive framework 500 which is controlled from a controlling device 6 as desired.

In addition to the mentioned collective drive 56, a stationary auxiliary drive 57 is also provided. It is equipped with an auxiliary drive belt 53 which extends alongside the machine, next to the main drive belt 5 used to drive the spinning rotors 1 at normal spinning speed. While the main drive belt 5 is destined to drive a plurality of spinning rotors 1 collectively, the auxiliary drive belt 53 is destined to drive only one spinning rotor 1 at a time, in the thread joining phase. For this reason the auxiliary drive belt 53 need not be made as solidly, so that its width can be narrower than that of the main drive belt 5. This has a beneficial effect on space utilization.

FIG. 1 shows a step-up gear 3 with a stepped speed pulley 34 as the central device for the auxiliary drive belt 53. Said speed pulley 34 has a first linear segment 340 of greater diameter to drive the main drive belt 5 and a second linear segment 341 of smaller diameter to drive the auxiliary drive belt 535. The diameter ratio between the linear segments 340 and 341 determines the gradation between the rotational speed of the spinning rotor 1 for production and that for thread joining.

Figure 6:
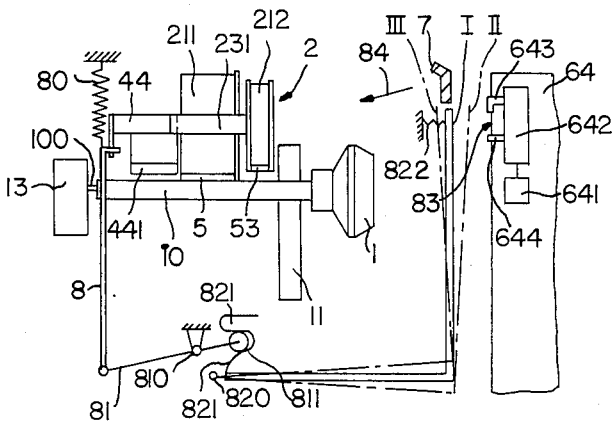
FIG. 6 shows a spinning station designed according to this invention as well as a service unit interacting with said spinning station, in schematic cross-section.

Shaft 10 is supported by its end towards spinning rotor 1 in the nip of a pair of support rollers 11. Its end 100 away from spinning rotor 1 is of reduced diameter and is supported by a combined axial/radial bearing 13 (FIG. 6).

A switch-over device 2 with a two-armed switch-over lever 20, supported pivotably on a shaft 201, is provided at each spinning station S. The switch-over lever 20 is provided with a main clamping roller 211 on one arm 230 which can be brought to bear against the main drive belt 5, while the other arm 231 of the switch-over lever 20 is equipped with an auxiliary clamping roller 212 which can be brought to bear against the auxiliary drive belt 53.

Between the individual spinning stations S are conventional supporting rings or discs 50 and 51 (FIG. 8) which lift the main drive belt 5 or the auxiliary drive belt 53 from shaft 10 of the spinning rotor 1 upon being enabled by the main clamping roller 211 or the auxiliary clamping roller 212. In this way, only one of the belts 5 or 53 at a time is in contact with shaft 10 of the spinning rotor 1 which is forced into this contact by the corresponding clamping roller 211 or 212.

When a thread is to be joined individually at a spinning station S because of thread breakage or some other reason, the switch-over lever 20 at the spinning station S concerned is pivoted (in a manner to be explained in further detail hereinbelow) so that the main clamping roller 211 releases the main drive belt 5, allowing the supporting discs 50 and 51 to lift this main drive belt 5 off the shaft 10 while the auxiliary clamping roller 212 applies the auxiliary drive belt 53 against shaft 10 of the spinning rotor 1. The spinning rotor 1 of this spinning station is thus separated from the collective drive constituted by main drive belt 5 and is now driven at a lower thread-joining speed.

Upon completion of the thread-joining operation the switch-over lever 20 switches back to normal spinning speed through release of auxiliary drive belt 53 (which now lifts away from shaft 10) by the auxiliary clamping roller 212, and through the application of the main drive belt 5 against shaft 10 of the spinning rotor 1 by means of the main clamping roller 211.

The switch-over lever 20 thus brings either the main drive belt 5 or the auxiliary drive belt 53 to bear upon spinning rotor 1 as selected.

The switch-over lever 20 can be controlled in different ways, as shall be explained further on through different examples. In the simplest case the switch-over lever is pivoted manually.

The thread joining speed is determined by changing the step-up ratio and this is achieved by appropriate selection of the stepped speed pulley 35 in the drive frame 500 of the machine. In this way the speed ratio is set for all of the spinning station S of the machine, so that the desired adaptation can be achieved quickly when batches, yarn numbers or rotors are replaced.

Figure 2:
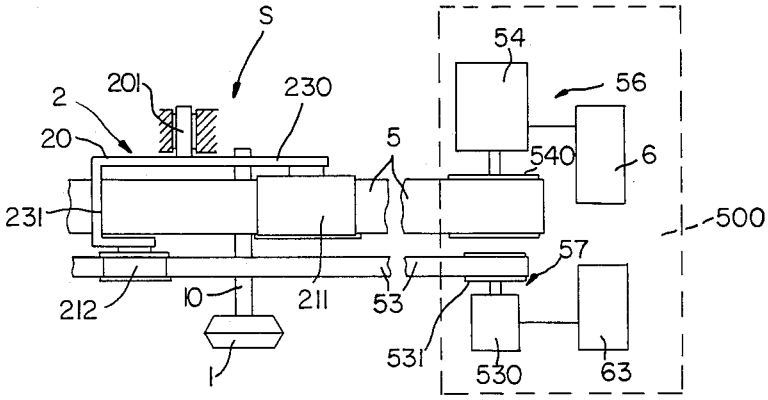
FIG. 2 shows a variation of the embodiment of the invention in top view.

FIG. 2 shows a variation of the central drive for the auxiliary drive belt 53 shown in FIG. 1. This central drive makes it possible to control the run-up of the speed of auxiliary drive belt 53. In this embodiment the main drive belt 5 as well as the auxiliary drive belt 53 are driven from a central location, i.e. drive frame 500 which is equipped for that purpose with an auxiliary drive motor 530 in addition to the above-mentioned main motor 54. The main drive belt 5 is then driven by the main motor 54 via a pulley 540. The speed of motor 54 and thereby of the main drive belt 5 is determined by the control device 6 already mentioned in connection with FIG. 1. The auxiliary drive belt 53 is driven by the auxiliary drive motor 530 via a pulley 531. The auxiliary drive motor 530 is provided with a control device 63 by means of which the speed of the auxiliary drive motor 530, and thereby of the auxiliary drive belt 53, is selected.

The auxiliary drive motor 530 drives the auxiliary drive belt 53 at a speed which is lower than the speed of main drive belt 5. Experience has shown that, depending upon the set rotational speed of the spinning rotor 1 and its diameter, a rotor speed of the spinning rotor 1 from 75% to 95% of the normal production speed of the spinning rotor 1 ensures especially secure thread joining. For this reason the speed difference is selected so that the speed ratio between thread joining speed and spinning speed lies within a range from 95:100 to 75:100.

The speed gradation is preselected by appropriate setting of the control devices 6 and 63. Provision can here be made to increase the speed of the auxiliary drive motor 530 by means of control device 63 after completion of thread joining until the main drive belt 5 and the auxiliary drive belt 53 run at the same speed. To achieve this, a coupling (not shown) can be provided between the control devices 6 and 63 which could also take into account possible differences in dimension between the pulley 540 and the pulley 531.

Thread joining cannot always be carried out optimally at the same thread joining speed. Depending upon the fiber material to be spun, upon the yarn number, the rotor diameter etc., different thread joining speeds are to be selected for thread joining so that perfect joints are obtained, from the point of view of strength as well as looks. For this reason the speed of the auxiliary drive motor 530 is selected in such a way, by comparison to the main motor 54, and depending upon the given conditions (essentially influenced by the above-mentioned factors) that the speed of the spinning rotor 1 is 25% to 5% lower than the production speed imparted to the spinning rotors 1 by means of the main drive belt 5.

The higher the rotational speed for thread joining, i.e. the less it deviates from production speed, the less does the character of the joint and of the following yarn segment differ from the remainder of the yarn. For this reason it is advisable to carry out thread joining at as high a rotor speed as possible. Depending upon the elasticity of the fiber material however, the same number of RPMs cannot always be selected for the spinning rotor 1. If the speed is too high, the yarn being formed is over twisted and therefore twisted off, so that the thread breaks. If the rotational speed is too low, the joint will differ too much from the remainder of the yarn. Especially when using living fiber material, such as cotton or wool, the thread joining operation is therefore preferably carried out at a rotor speed merely 5% to 25% below the rotor speed for production.

By running up the rotor speed from thread joining speed to normal spinning speed before the transfer or rotor drive from the auxiliary drive belt 53 to the main drive belt 5, smoothmenss of transfer is ensures which is therefore gentle on the yarn. As a result there are fewer breaks in the yarn.

It has been shown that the fibers do not reach the spinning rotor 1 jerkily after thread joining. The fibers retained in the feeding device (not shown) in the form of a fiber tuft are of different lengths and are therefore not released at the same time when the feeding device is again switched on. At first there are only a few fibers being conveyed from the opening device (also not shown) to the spinning rotor 1. In time there are more fibers until finally the normal feeding quantity reaches the spinning rotor 1. The fiber quantity coming into the spinning rotor 1 increases here along a run-up curve the course of which is influenced by several factors, such as fiber length, feeding speed, etc.

The run-up curve of the auxiliary drive motor 530, controlled via control device 63, can be adapted to the run-up curve of the fiber quantity arriving into the spinning rotor 1 after thread joining in such a way that as constant a relationship as possible is maintained between the two run-up curves.

Figure 3:
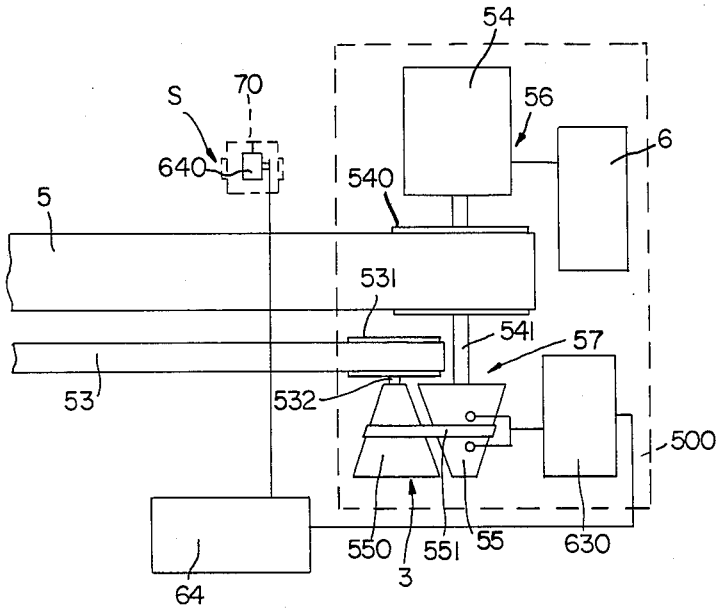
FIG. 3 is a schematic representation of a further variation with a continuously adjustable step-up gear according to the invention.

In the embodiment shown in FIG. 3 the pulley 531 of the auxiliary drive belt 53 is also driven (as shown in FIG. 1) from the main drive motor 54 with intercalation of a step-up gear 3. For this purpose a cone wheel 55 of a cone wheel gear is located on shaft 541 on which the pulley 540 for the drive belt 5 is rigidly supported for rotation with shaft 541. The second cone wheel 550 of this gear is located on a shaft 532 which also supports the belt pulley 531 for the auxiliary drive belt 53. A belt 551 loops around the two cone wheels 55 and 550 together, said belt being movable parallel to the shafts 541 and 532 by means of a control mechanism 630.

In a manner similar to that described for the two motors 54 and 530 (FIG. 2), the speed of the auxiliary drive belt 53 can be accelerated here too until it reaches the speed of the drive belt 5 after completion of a thread joining operation.

The control mechanism 630, and possibly also the control device 6, are controllably linked to a service unit 64 travelling alongside the spinning machine. Trailing cables can be used for example, to ensure power supply to the service unit 64. The above-mentioned acceleration of the auxiliary drive belt 53 can thus be controlled from the travelling service device 64.

A predetermined initial position of the belt 551 can be set by the control mechanism 630. This initial position can in turn be used to determine the step-up ratio between the drives for the main drive belt 5 and for the auxiliary belt drive 53 while taking into account possible diameter differences between the pulleys 540 and 531.

Figure 11:
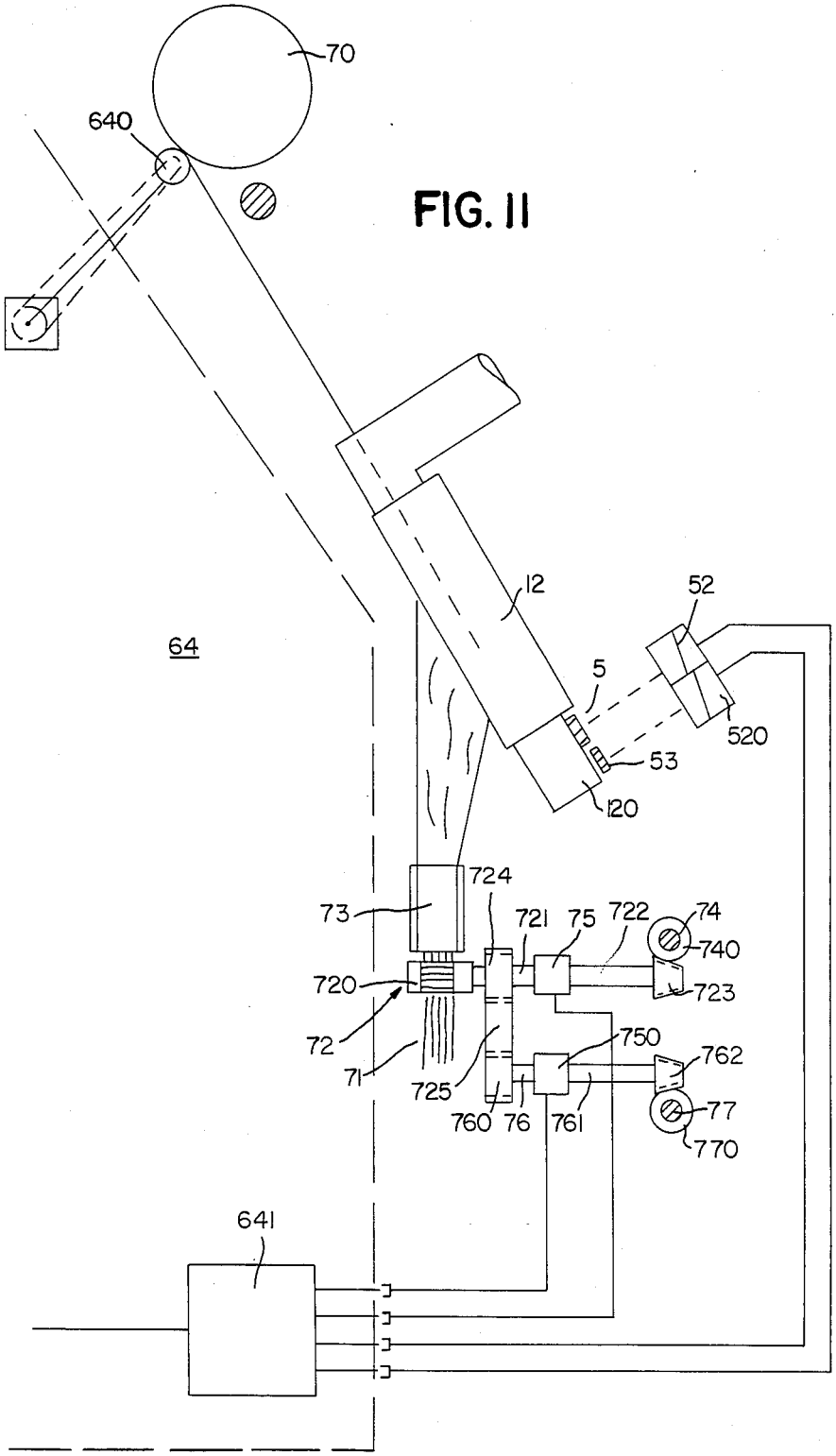
FIG. 11 is a schematic side view of a spinning station with a pair of friction rollers and a feeding roller, with a first and a second drive respectively.

As shown in FIGS. 3 and 11, the service unit 64 supports an auxiliary drive roller 640 which is driven in a conventional (not shown) manner from the service unit 64. This auxiliary drive roller 640 can be applied against a bobbin 70 at the spinning station S at which the thread is to be joined during the thread joining phase in order to feed the thread back to the spinning rotor 1 for joining, and to draw off the thread again from the spinning rotor 1 after completion of the thread joining operation. The drive of the auxiliary drive roller 640 and the control mechanism 630 are controllably linked to each other via the service unit 64 so that a constant ratio between rotor speed and thread draw-off speed may be maintained.

In the device shown in FIG. 1, the thread joining speed is also selected by means of a switch-over lever 20 provided at each spinning station S individually.

Figure 4:
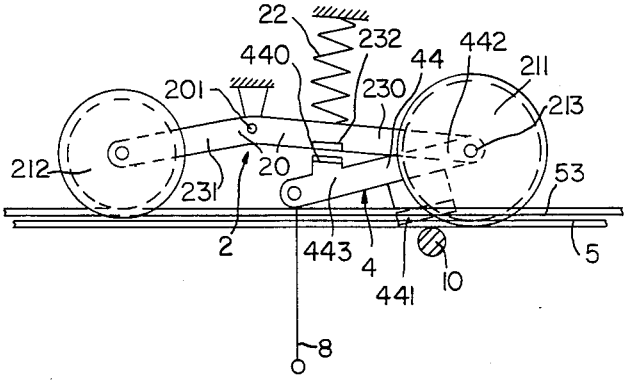
FIG. 4 is a schematic front view of a device coupled to a brake according to this invention to selectively drive a spinning rotor at production speed or at a lower thread joining speed.

FIG. 4 shows a front view of the switch-over device 2 with switch-over lever 20 shown in FIGS. 1 and 2. Such a switch-over device 20 is provided individually for each spinning station S. In this embodiment the arm 230 with the main clamping roller 211 is provided with a pressure spring 22 which normally holds the main drive belt 5 in contact against shaft 10 of the spinning rotor 1 when the switch-over device 20 is enabled by means of the main clamping roller 211.

According to the embodiment of FIG. 4 the switch-over device 20 is connected controllably to a brake 4 for the spinning element. For this purpose a brake lever 44 is pivotably supported on shaft 213 of the main clamping roller 211, whereby a tie rod 8 attaches at the free end of said brake lever. The brake lever 44 is installed at an angle to arm 230 of the switch-over device 20. Its free end is closer to the plane of the main drive belt 5 than arm 230 of lever 20. This arm 230 is equipped with a stop 232 on its side towards the brake lever 44, whereby a carrier 440 installed near the free end of brake lever 44 can be brought to rest against said stop 232.

The brake lever 44 is provided with a brake lining 441 near shaft 213 which can be brought to bear against shaft 10 of the spinning rotor 1, also located in immediate proximity of the main clamping roller 211. The position of brake lever 44 with brake lining 441 subdivides brake lever 44 into a shorter lever arm 443 which faces the main clamping roller 211 and a longer lever arm 442 facing the free end, at which the tie-rod 8 attacks.

FIG. 4 shows the device in spinning position, in which the main drive belt 5 is in bearing contact with shaft 10 of the spinning rotor 1. If the spinning rotor 1 is to be shut down, the brake lever 44, together with its brake lining 441, is moved by means of tie rod 8 in the direction of support roller or disc 11 (see FIGS. 6 and 8–10), so that lining 441 is applied against the shaft 10. Further movement of the tie rod 8 causes the brake lever 44 to act as a two-armed lever supported on shaft 10 of spinning rotor 1 and lifting the main clamping roller 211 with its lever arm 442 to the extent that the main drive belt is lifted away from shaft 10 by the supporting discs 50 and 51 (see FIG. 8). Switch-over lever 20, is however not yet moved to such an extent so as to bring the auxiliary belt 53 to bear against the shaft 10 of spinning rotor 1 by means of auxiliary clamping roller 212.

If the lower rotor speed is to be selected now for thread joining, the tie rod 8 is moved against the switch-over device 20. At the same time the carrier 440 of brake lever 44 comes to bear against the stop 232 of the switch-over device 20. The latter is then pivoted so that the main clamping roller 211 releases the main drive belt 5 while the auxiliary clamping roller 212 presses against the auxiliary drive belt 53. The main drive belt 5 is lifted away from shaft 10 by the supporting discs 50 and 51 while the auxiliary drive belt 53, which is driven by the stepped speed pulley 34 (FIG. 3), by the auxiliary drive motor 530 (FIG. 1), or by the cone wheel gears 55, 550 (FIG. 2), at a slower speed than that of the main drive belt 5, comes to bear against shaft 10.

A movement of the tie rod 8, and thereby also of the brake lever 44 in one direction causes braking of the spinning rotor 1 and causes the main drive belt 5 as well as the auxiliary drive belt 53 to be simultaneously lifted away from shaft 10 while the movement of the tie rod 8 and brake lever 44 in opposite direction causes the main drive belt 5 to be lifted away from shaft 10 while the auxiliary drive belt 53 comes to bear against shaft 10.

As is shown in FIG. 4, arm 230 of the two-armed switch-over device 20 is spring loaded by a pressure spring 22, together with the main clamping roller 211, in such manner as to cause the switch-over device 20 to return into its spinning position when it is neither pulled nor pushed by the tie rod 8. In this spinning position the main clamping roller 211 presses the main drive belt 5 against shaft 10 of the spinning rotor 1 while the auxiliary clamping roller 212 releases the auxiliary drive belt 53 which is lifted away from shaft 10 through the action of the supporting discs 50 and 51 (see FIG. 8). By means of this pressure spring 22 (or some other elastic element) the main drive belt 5 is thus brought to bear against shaft 10 of the spinning rotor 1 (or some other drive element connected to and rotating together with the spinning rotor 1, such as for example a driving wharve) when the switch-over device 2 is enabled.

Figure 5:
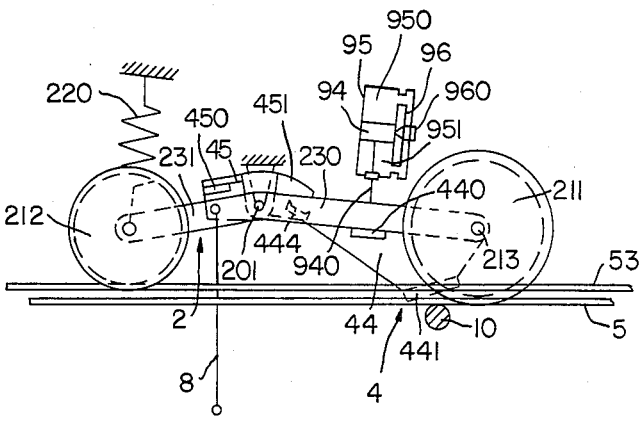
FIG. 5 is a front view of a variation of the device shown in FIG. 4.

In the embodiment of FIG. 5 the brake 4 consists of a driven intermediate lever 45 and the actual brake lever 44. The intermediate lever 45 is located on the shaft 201 of the switch-over device 20 and its end on the side of auxiliary roller 212 engages the tie rod 8. Furthermore, this end of the intermediate lever 45 is provided with a carrier 450 which overlaps the arm 231 of the switch-over lever 2 on its side away from shaft 10.

The end of the intermediate lever 45 on the side of the main clamping roller 211 is in the configuration of a fork 451 and reaches around a pin 444 at the free end of the brake lever 44 supported on the shaft 213 of the main clamping roller 211. The intermediate lever 45 is thus articulately linked to the end of the brake lever 44 which is pivotably supported on the shaft 213 of the main clamping roller 211. Said brake lever 44 has a carrier 440 (as shown in FIG. 4) by which it can be brought to bear against the side of arm 230 of the switch-over device 20 facing spinning rotor 1, so that the brake lever 44, together with its carrier 440, reaches under arm 230 of the switch-over device 20.

Arm 231 of the switch-over device 20 is spring-loaded by means of a pull spring 220 so that the main clamping roller 221 moves the main drive belt 5 against shaft 10 of the spinning rotor 1 when the switch-over device 20 is enabled.

In this embodiment of the device the moving mechanisms of the tie rod 8 for the obtention of certain functions are reversed, in comparison with those shown in FIG. 4. When the tie rod 8 is lifted, carrier 450 of the intermediate lever 45 is lifted away from arm 231 of the switch-over lever 2 and the brake lever 44 is pivoted by the intermediate shaft 45 against shaft 10 of the spinning rotor 1. Spinning rotor 1 is thus stopped. When the movement of tie rod 8 continues, brake lever 44 bears upon shaft 10 which now constitutes a pivoting axis for brake lever 44 and lifts the main clamping roller 211 away from main drive belt 5 while bringing auxiliary clamping roller 212 into contact with the auxiliary drive belt 53.

When the tie rod 8 is pulled down, stop 450 of the intermediary lever 45 causes slaving of the switch-over lever 2 and presses auxiliary drive belt 53 against shaft 10 via its auxiliary clamping roller 212. The main drive belt 5 which is simultaneously released by the main clamping roller 211 is thereby lifted away from shaft 10 of the spinning rotor 1 by the supporting discs 50 and 51 (see FIG. 8).

When the tie rod 8 is in its starting position the two-armed switch-over lever 20 assumes the spinning position under the effect of the spring 220. Spinning rotor 1 receives its driving force in this position from main drive belt 5.

The tie rod 8 can be controlled by means of the device shown in FIG. 6. In this embodiment a spring 80 exerts constant direct or indirect pull upon tie rod 8 whereby it is kept in the position in which the brake lining 440 of brake lever 44 is lifted away from shaft 10. Tie rod 8 is connected to a two-armed lever 81, pivotable around an axis 810. The two-armed lever 81 is stopped by a control lever 82 pivotable around an axis 820. For this purpose, control lever 82 is provided with a drive fork 821 reaching around a roller 811 of lever 81. Control lever 82 is located in a slit 700 (FIG. 12) of a cover 7 of the spinning station 5 and can be moved in relation to same. As shown in FIG. 6, control lever 82 is in alignment with cover 7. In this position I the switch-over roller 20 assumes its spinning position in which the main clamping roller 211 holds the main drive belt 5 in contact with shaft 10 of spinning rotor 1.

If access is to be gained to the spinning rotor 1 for the purpose of maintenance, the rotor housing (not shown) is opened by unhinging the cover 7 (FIG. 6). This cover 7 simultaneously activates control lever 82 which is pivoted in direction of arrow 83 into position II and releases lever 81 at the same time.

Spring 80 thereby moves tie rod 8 so that brake lever 44 is brought into its braking position and switch-over lever 20 is brought into its neutral intermediate position, whereby neither the main drive belt 5 nor the auxiliary drive belt 53 are in contact with shaft 10.

Following maintenance, the cover 7 (FIG. 6) of the rotor housing (not shown) is closed again. The control lever 82 is left in the unhinged position or is brought into the unhinged position. The brake lever 44 thus again assumes a braking position.

In synchronization with the feed-back of the thread end into the spinning element the control lever 82 is then pushed in the direction of arrow 84, into position III within cover 7, against the force of a readjusting spring 822. At the same time the main clamping roller 211 is lifted away from the main drive belt 5 via tie rod 81 in the above described manner, and the auxiliary clamping roller 212 is pressed against the auxiliary drive belt 53 so that the spinning rotor 1 is now driven by said auxiliary drive belt 53.

It is also possible to control the movement of the control lever 82 manually or from the service unit 64, independently of or in interaction with the cover 7. This service unit 64 is equipped in conventional manner with a control panel 641 (FIG. 6) which controls the entire thread joining process. This control panel 641 is connected to a driving mechanism 642 for the unlocking mechanism 643 of control lever 82 or cover 7. The driving mechanism 642 can be made in form of a camshaft, for example, with a plurality of cams, one of these cams causing the return of cover 7 and/or of control lever 82 from position II into position I in which it lies flush with cover 7. This driving mechanism 642 is furthermore provided with a bolt 644 which is pressed against the control lever 82, pivoting it from its position I into position III against the force of the readjustment spring 822, to bring about the reduced thread joining speed. In this way the driving mechanism 642 installed in the service unit 64 serves to control the switch-over lever 20 in such manner as to stop the spinning rotor 1 via unlocking device 643, to drive said spinning rotor 1 at reduced rotor speed for thread joining and to drive it at normal production speed in a manner not shown.

The above described embodiment of the device used to control the drive of a spinning element is especially suited for control via a service unit 64 which travels alongside the spinning machine.

The operator needs both hands in manual thread joining to feed the thread back into the spinning rotor 1 and to enable fiber feeding at the precisely right, predetermined time. The operator is thus unable to keep the control lever 82 pushed in the direction of arrow 84, as the service unit 64 does it in the embodiment shown in FIG. 6.

Figure 12:
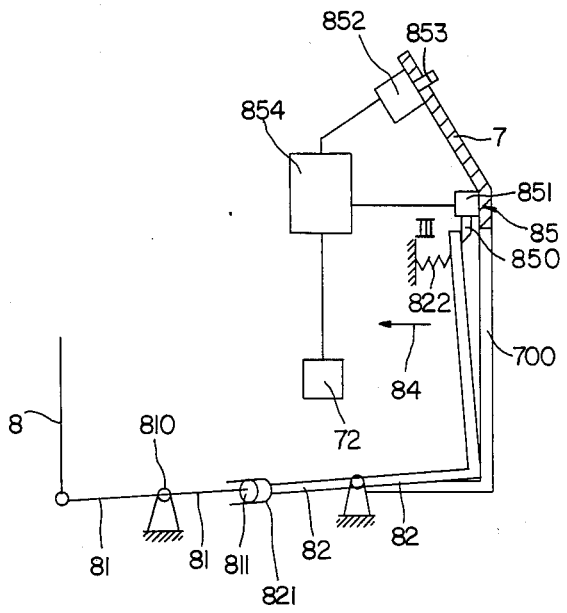
FIG. 12 is a schematic side view of a spinning station cover and of a control lever, particularly well suited for manual control of the device according to invention.

In order to be nevertheless able to control the rotor speed for the thread joining process in a simple way, when a machine is to be controlled manually, the device shown in FIG. 6 is adapted according to the variation of FIG. 12. In this case a locking device 85 is provided for the control lever 82 to hold it back in thread joining position III. So that the locking device 85 does not have to be handled when the control lever 82 moves from production position I (see FIG. 6) into thread joining position III and when it moves back into production position, the locking device 85 is equipped with a spring loaded catch 850 which gets out of the way of the arriving control lever 82 and which catches behind it when the spinning position III is reached. A controllable solenoid 851 on catch 850 enables the control lever 82.

In the embodiment shown, a switching device 852 for the fiber feeding device 72 (see FIG. 11) is installed on the cover and is activated by means of a push-button 853. The switching device 852 is controllably connected to the above-mentioned fiber feeding device 72 and with solenoid 851 via a control device 854.

For thread joining, the control lever 82 is brought into thread joining position III, where it is secured by the catching catch. The spinning rotor 1 is thus driven in the described manner and at a lower speed. The thread is fed back up to the collecting surface of the spinning rotor 1 in a known manner (not shown). Similarly, fiber feeding to the spinning rotor 1 is switched on in a known manner at the desired moment by activating push button 853. When the thread joining process is completed and the conventional (and therefore not shown) thread monitor ascertains that normal spinning tension has been reached, the push button 853 is released.

At the moment of release of push button 853 the control device 854 briefly excites the solenoid 851. Said solenoid releases the control lever 82 so that it is returned to its production position I by the readjustment spring 822 and is held there by another, not shown stop. The spinning rotor 1 is thus driven once more at full production speed.

If thread joining was unsuccessful, the control lever 82 is again brought into its thread joining position III and the thread joining process is repeated.

Figures 13A, 13B, 13C:
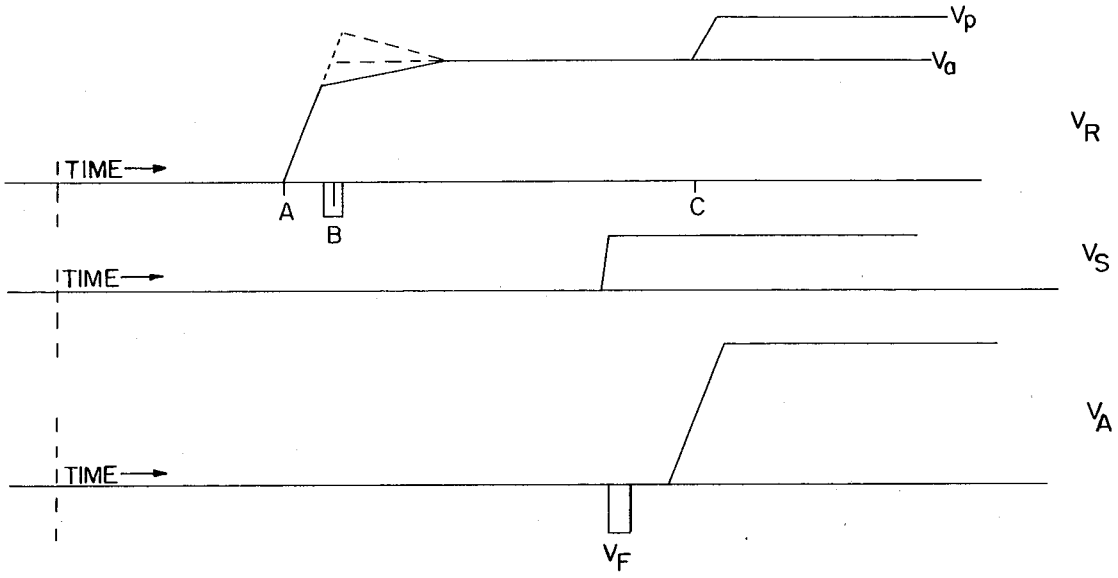
FIGS. 13A–13C represent explanatory diagrams summarizing particularly the present thread joining process as related to the exemplary devices of FIGS. 6 and 12.

As can be seen in FIG. 6, the control lever 82 must pass through production position I in its movement from maintenance or braking position II into thread joining position III. This raises the possibility of a particularly advantageous acceleration process, as discussed with reference to FIG. 13. FIGS. 13 A, B, and C illustrate rotor speed $V_R$, the degree of fiber feeding $V_S$, and the thread draw-off speed $V_A$, all in a relative time line fashion, respectively.

As previously discussed, during maintenance control lever 82 assumes position II until the maintenance procedure (for example, a cleaning of spinning rotor 1) is concluded. At an arbitrary time A, control lever 82 is then brought from maintenance position II into production position I, in which the spinning rotor 1 is driven by the main drive belt 5. Spinning rotor 1 is accelerated in this manner. As soon as it has reached its rotational speed for thread joining (generally somewhere in time period B), which is predetermined as the drive speed of the auxiliary drive belt 53, control lever 82 is moved into thread joining position III.

The general period A to B may be preset in control device 641 (FIG. 6) of the maintenance device 64. Spinning rotor 1 will however not always reach the precise rotor speed $V_a$ for thread joining within a prescribed period of time, but will deviate within certain tolerance values upwards or down from this rotor speed $V_a$ due to the manufacturing tolerances, condition of the rotor bearings, etc. This is represented in FIG. 13 by the different dotted lines on the $V_a$ curve.

As specified above, in the thread joining position III, the main drive belt 5 is lifted away from shaft 10 of the spinning rotor 1 and the auxiliary drive belt 53 is instead brought into contact with this shaft 10. Thus, the auxiliary drive belt 53 maintains the spinning rotor 1 at the thread joining rotor speed Va basically established with the acceleration period under the drive power of main belt 5. If the spinning rotor 1 did not yet reach such thread joining rotor speed $V_a$ under the temporary acceleration of position I described above, or if it has already exceeded it somewhat, the auxiliary drive belt 53 brings spinning rotor 1 more precisely to such thread joining rotor speed $V_a$.

At the thread joining rotor speed $V_a$, the usual operating phases then required for subsequent actual joining, such as switching on fiber feeding (see curve $V_s$ of FIG. 13B), feedback of the thread into spinning rotor 1 (see time period $V_F$ of FIG. 13C), and renewed drawing-off of the thread (see curve $V_A$ of FIG. 13C), occur in the usual manner at thread joining rotor speed $V_a$. In further coordination therewith, control lever 82 is released from thread joining position III (generally around relative time C), so that it returns into production position I under the influence of the readjusting spring 822, as described above. The auxiliary drive belt 53 is thereby lifted from shaft 10 of the spinning rotor 1 and the main drive belt 5 is re-applied to shaft 10. The spinning rotor 1 is thereby accelerated from the thread joining rotor speed $V_a$ to the production rotor speed $V_p$, all as outlined above, particularly with reference to FIGS. 6 and 12.

The preceding description, drawn from the structure and operation of devices such as in present FIGS. 6 and 12, shows that rotor acceleration is substantially effected with the wider, stronger main drive belt 5, while the narrower and much weaker auxiliary drive belt 53 does not have to effect any change in speed, aside from some minor speed corrections. Auxiliary belt 53 merely has to maintain spinning rotor 1 at the thread joining rotor speed $V_a$ generally accelerated to with main belt 5. This accounts greatly for a long life of the auxiliary drive belt 53.

As a rule the deviations from the preset drive rotor speed $V_a$, occurring at the time of drive transfer to belt 53 from main drive belt 5, are so minimal that they can be tolerated without danger and will not overload auxiliary drive belt 53. However, if even corrections of the thread joining rotor speed $V_a$ effected by auxiliary drive belt 53 are to be avoided, spinning rotor 1 can be equipped with a device to monitor its speed. In such manner, it is possible to precisely time movement of control lever 82 by the maintenance service unit 64 so that such corrections are no longer necessary In practice it may not be completely possible to avoid deposits of impurities in the collecting groove of the spinning rotor 1, which may provoke an imbalance of the spinning rotor 1. In order to avoid increased wear of the main clamping roller 211 of the switch-over lever 20 and of its bearings as a result of such imbalance, said switch-over lever 20 is equipped with a damping device 9 in the shown embodiment. As shown in FIG. 1, the damping device 9 is made in the form of a frictional damper which is equipped with a rubber bushing 90 in the shown embodiment.

Figure 7:
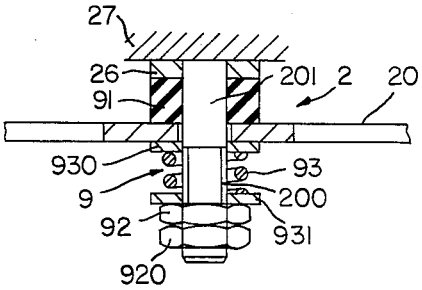
FIG. 7 shows a damping device for a device in accordance with this invention, in cross-section.

The damping device 9 can be made in different ways. FIG. 7 shows a variation in which an elastic bushing 91 is provided between a disk 26 which is in contact with the part 27 of the machine frame supporting shaft 201 of switch-over lever 20 and switch-over lever 20. Threads 200 are located on the end of shaft 201 away from part 27, a nut 92 and a counter-nut 920 being screwed onto these threads. Between the switch-over lever 20 and a disk 930 on the one hand, and the two nuts 92 and 920 and a disk 931 on the other hand, a pressure spring 93 snaps in. Depending upon the tension of pressure spring 93, preset by nut 92 and counter-nut 920, the switch-over lever 20 is pressed with more or less force against the elastic bushing 91, so that the damping effect of the damping device 9 can be set by presetting the tension.

FIG. 5 shows a further variation of a damping device 9 for the switch-over lever 20. In this embodiment, a piston 94 is connected to the switch-over lever 20 via a piston rod 940, said piston separating two chambers, 950 and 951, from each other within a cylinder. These two chambers 950 and 951 are connected to each other through a throttle line 96 in which a throttle valve 960 is built in, as shown in the example. Cylinder 95 as well as throttle line 96 are filled with a medium which is brought from one chamber 950, into the other chamber 951 (or vice versa) by the piston 94. Due to the narrow cross section of the throttle line 96 and due to the presetting of the throttle valve 960, the medium cannot pass easily from one chamber into the other however, and thereby the desired damping effect is achieved.

As the above description shows, the device to drive the machine at different defined speeds can be made in various ways. At the same time, the instant invention is not limited only to the embodiments shown as examples, but the different characteristics can rather be interchanged among each other or through equivalents, or can be used in different combinations. It is therefore absolutely possible to use two pairs of disks and a conventional axial bearing or a conventional direct bearing for the spinning rotor 1, rather than the shown support rollers 11 and combined axial/radial bearing 13.

It is also not necessary to provide two tangential belts (main drive belt 5 and auxiliary drive belt 53) to drive the spinning rotora 1. Here too, a different, appropriate collective drive and/or auxiliary drive can be provided, for example by driving one or more spinning rotors 1 from a main roller via one or more belts attributed to spinning rotors 1, looping with more or less greater force around the shaft 10 of the spinning rotor 1. Neither is it necessary to install the auxiliary drive 57 in the drive framework 500 of the machine. As an alternative it is also possible to install it in the middle between several sections of the machine, or stationary, per section.

The switch-over device 2 also must not necessarily be made in the form of a two-armed switch-over lever 20. Instead of such a two-armed switch-over lever 20, a separate switch-over lever can be provided for the main clamping roller 211 as well as for the auxiliary clamping roller 212, it being only necessary to coordinate their movements with each other in order to obtain the described effect. This can be achieved by electric-pneumatic or electrical means, or by some other means. The same applies also to the brake lever which can be moved by a driving mechanism that is independent of switch-over device 2 but is coordinated with its activation.

Figure 8:
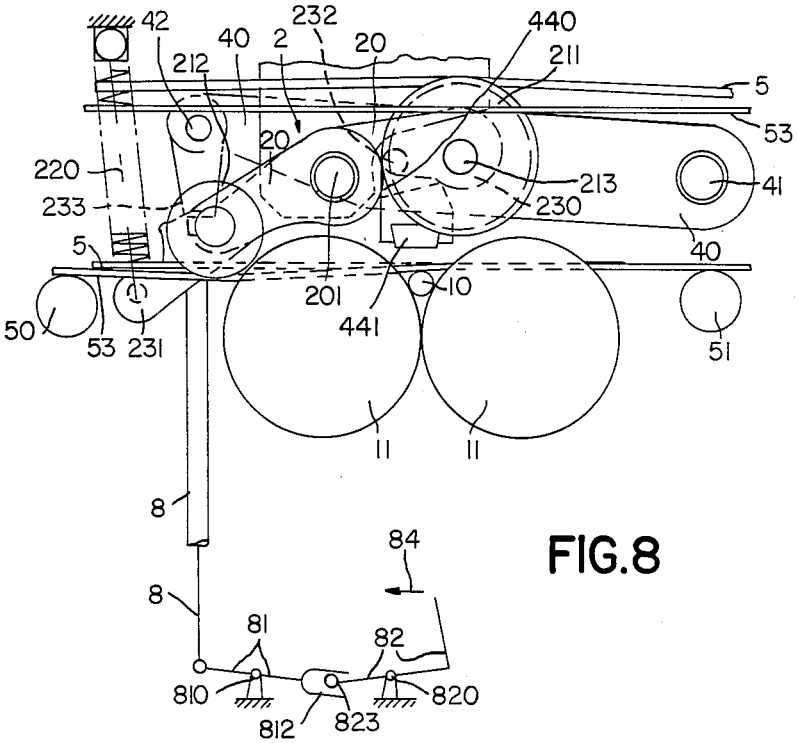
FIGS. 8–10 are schematic front views of the preferred embodiment of the invention with a switch-over lever and a brake level, supported independently of the former, in thread joining, spinning or braking position.
Figure 9:
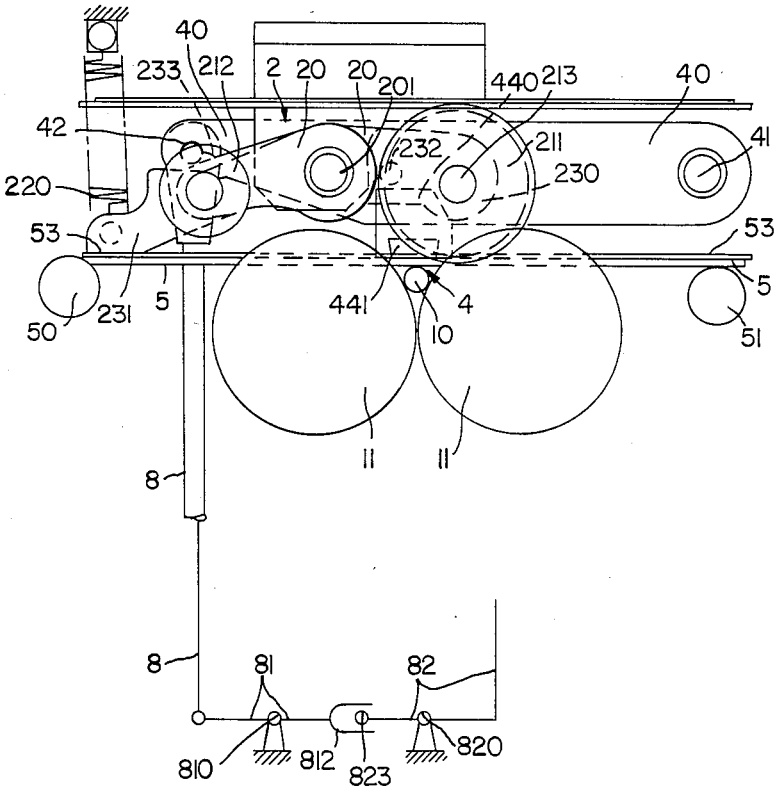
Figure 10:
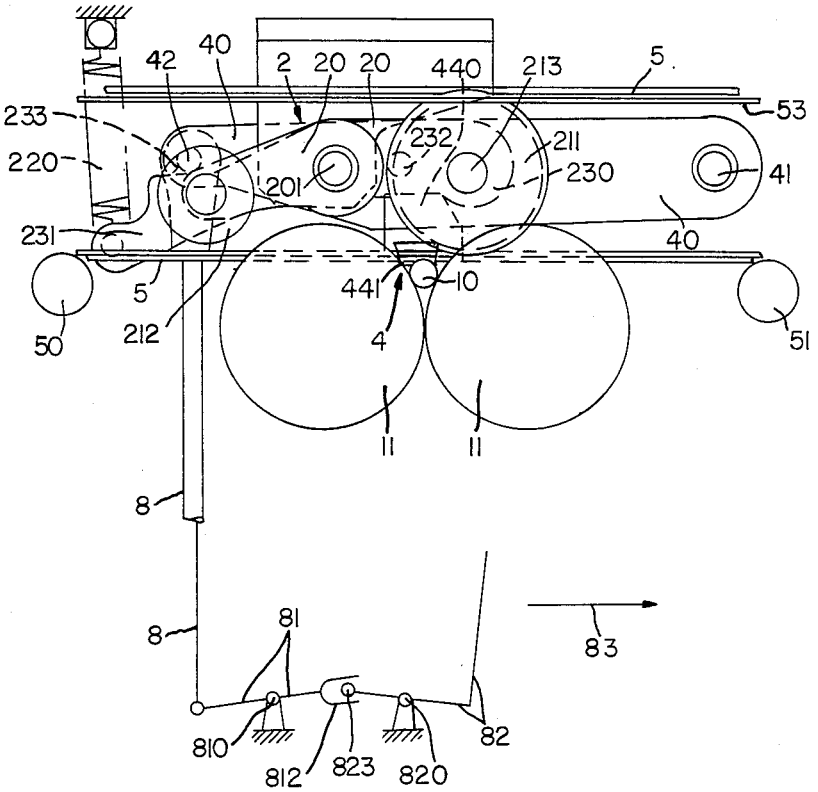

Such a device, in which the brake lever 40 is supported independently of the switch-over lever 20, but is moved in coordination therewith, is now explained in FIGS. 8 through 10.

The brake lever 40 is pivotably supported on the one side of shaft 10 on a bearing bolt 41 and extends over and beyond the two supporting discs 11 and shaft 10 of the spinning rotor 1 up to the other side of shaft 10. At this point the tie rod 8 is linked to the free end of the brake lever 40 by means of a bolt 42. Bolt 42 reaches beyond arm 231 of the two-armed switch-over lever 20 on its side away from shaft 10 of spinning rotor 1, said side being configured as a bumper surface 233. Bolt 42 of the brake lever 40, in turn, is configured as a bumper which can be brought into contact with this bumper surface 233 of the switchover lever 20.

As schematically shown, the control lever 82 is a two-armed lever in this embodiment, provided with a roller 823 on its end towards lever 81, said roller being held by the fork 812 of lever 81. The position of tie rod 8 must thus be controlled in function of the position of the control lever 82.

In spinning position, where the control lever 82 assumes its position I (see FIG. 6) the brake lever 40 and the switch-over lever 20 assume the position shown in FIG. 9. At the same time the switch-over lever 20, due to the force exerted by pull spring 220, is held with its bumper surface 233 in contact against bolt 42 of the brake lever 40. In this position of switch-over lever 20 the main clamping roller 211 presses the main drive belt 5 against shaft 10 of spinning rotor 1 while the auxiliary clamping roller 212 releases the auxiliary drive belt 53 which is lifted away from shaft 10 through the action of the supporting discs 50 and 51. For stopping of spinning rotor 1, control lever 82 may be moved independently of a movement of cover 7 (see FIG. 6) or together with the latter in the direction of arrow 83 (FIG. 10). Tie rod 8 therefore is drawn downwardly (as shown by the Figures themselves) and brings brake lever 40 with brake lining 441 to bear against shaft 10 of spinning rotor 1. At the same time the spinning rotor 1 is stopped. Furthermore, when this movement takes place, the tie rod 8 brings the carrier of brake lever 40, in the form of bolt 42, to bear against the bumper surface 233 of the switch-over lever 20 and finally takes said switch-over lever 20 along with it. The main clamping roller 211 thus releases the main drive belt 5 so that the latter is lifted from the shaft 10 by the two supporting discs 50 and 51 and is thus no longer driven.

FIGS. 8 through 10 show that through bearing support of the brake lever 40, independently of the switch-over lever 20, the brake lining 441 and the bearing bolt 41 can be spaced relatively far apart. Therefore the braking movement of the brake lining 441 during braking is nearly linear in the area of shaft 10 of spinning rotor 1, and this linear movement towards shaft 10 does not change greatly even after much wear so that, independently of the degree of brake lining wear, there is no danger for the brake lever 40 to get stuck on shaft 10.

When the maintenance operation for which spinning rotor 1 was shut down is completed, thread joining takes place. In coordination with the other phases of the thread joining process the control lever 82 is moved in direction of arrow 84 after closing of the cover 7 and is brought into position III (FIG. 8). The tie rod 8 is thus lifted, so that the bolt 42 releases arm 231 of the switch-over lever 20. During this lifting movement of the tie rod 8 the brake lever 40 is also pivoted around its axis 41. At the same time the carrier 440 comes to bear against bumper 232 of the switch-over lever 20. The latter is thereby pivoted so that the main clamping roller 211 is lifted away from the main drive belt 5 and the auxiliary clamping roller 212 is pressed against the auxiliary drive belt 53. Through this action the auxiliary drive belt 53 is brought to bear against shaft 10 of the spinning rotor 1 which is thus driven by this auxiliary drive belt 53; the main drive belt 5, released by main clamping roller 211 has been lifted away from shaft 10 by the supporting discs 50 and 51.

In the embodiment described in FIGS. 8 through 10, the brake lever thus serves to selectively pivot the switch-over lever 20 into one or the other pivoting directions in order to brake the spinning rotor 1 in this manner or to drive it at a predetermined thread joining speed, different from production speed. Also, upon completion of the thread joining operation, the spinning rotor 1 can be brought more or less rapidly and in a controlled manner up to production speed before the drive of spinning rotor 1 is again transferred to the main drive belt 5.

FIG. 11 shows a further variation of an open-end spinning station. In this embodiment a pair of friction rollers 12 are used as spinning element, instead of a spinning rotor. Each of the friction rollers 12 (only one roller being visible in FIG. 11) is equipped with a wharve 120 against which either main drive belt 5 or auxiliary drive belt 53 can be brought to bear. For this purpose each of the two belts 5 and 53 is provided with a fork (not shown). Each fork is controllably connected to a separate drive, e.g. a solenoid 52 or 520, whereby the two solenoids 52 and 520 are controlled in coordination with each other from control device 641 on the service unit 64. Thus for example, the fork (not shown) moved by solenoid 52, and tipped with rollers to reduce friction between itself and belt 5, can bring the main drive belt 5 to bear against wharve 120 when solenoid 52 drops off. When solenoid 52 is excited is excited wharve 120 is released by belt 5. In the same way, the solenoid 520 can bring the auxiliary drive belt 53 to bear against wharve 120 when excited and lift auxiliary drive belt 53 away from the wharve when it drops off. If solenoid 52 is excited and solenoid 520 drops off, wharve 120 is not driven at all.

As described in the context of FIGS. 2 and 3 the auxiliary drive belt 53 can again be driven at a speed which is lower than the speed of main drive belt 5 and can then be accelerated up to the speed of main drive belt 5 so that a smooth transfer of the drive to the main drive belt 5 can be ensured. It is however also possible to reverse the direction of the auxiliary drive belt 53 from the service unit 64 as a function of a thread joining program, for instance if this is desirable for the cleaning of the friction rollers 12. The drives of friction rollers 12 of other spinning stations remain unaffected however, so that these rollers continue to be driven by main drive belt 5 at production speed at such other stations. FIG. 11 shows that the fiber material 71 is conveyed by a fiber feeding device 72 and an opening roller 73 to the friction rollers 12. The fiber feeding device 72 is equipped with a feeding roller 720 which sits at one end of a feeding shaft 721. The feeding shaft 721 is connected by a coupling 75 to a feeding shaft 722 equipped with a worm wheel 723 which in turn engages an endless screw 740 located on a main drive shaft 74, part of the collective drive 56, said endless screw rotating together with said shaft.

Between feeding roller 720 and coupling 75 the feeding shaft 721 is provided with a gear 724 which is drivingly connected via a chain 725 with a gear 760. Gear 760 sits at the end of an intermediary shaft 76, connected via a coupling 750 to another intermediate shaft 761 which is equipped with a worm wheel 762 at its free end and is driven by an auxiliary drive shaft 77 (auxiliary drive 57) via an endless screw 77.

By controlling couplings 75 and 750 appropriately, the feed roller 720 can be driven by either the main drive shaft 74 or by the auxiliary drive shaft 77 or by neither of these two shafts 74 and 77, as selected. If desired, the feed roller 720 can also be rotated by the auxiliary drive 77 counter to the feeding direction in order to take the fiber tuft out of range of the opening roller 73. This reversal of the sense of rotation may be initiated by the usual thread monitor (not shown), or by means of service unit 64.

After thread joining the auxiliary drive shaft 77 can be accelerated to the production speed predetermined by the main drive shaft 74, in synchronization with bobbin 70 and/or with the friction rollers 12, whereupon simultaneous activation of couplings 75 and 750 transfers the drive from the auxiliary drive shaft 77 to the main drive shaft 74. It is obvious that such control of the feeding roller can also be applied in connection with a spinning element in the form of a spinning rotor 1 (see FIGS. 1 through 10).

We claim:

1. Open-end spinning machine with a plurality of spinning stations located next to each other, each station having a respective spinning unit, comprising:
   - one collective drive adapted for collectively driving said spinning units;
   - a stationary auxiliary drive, which instead of said collective drive, can be associated with the spinning unit of each spinning station individually; and
   - a drive motor for driving said collective drive directly and for driving said auxiliary drive via a step-up gear.

2. Spinning machine as in claim 1, wherein said auxiliary drive is installed in the drive framework of said machine.

3. Spinning machine as in claim 1, wherein said auxiliary drive includes its own drive motor, separate from any drive motor of said collective drive.

4. Spinning machine as in claim 1, wherein the step-up ratio of said step-up gear is set in a predetermined range, preferably between 95:100 and 75:100.

5. Spinning machine as in claim 4, wherein said step-up gear includes a stepped speed pulley.

6. Spinning machine as in claim 1, wherein said step-up gear is continuously adjustable.

7. Spinning machine as in claim 1, wherein the speed of said auxiliary drive is adjustable and can be increased up to the speed of said collective drive.

8. Spinning machine as in claim 7, further including control means for accelerating the speed of said auxiliary drive according to a run-up curve of the amount of fibers reaching a spinning unit as fed by a fiber feeding device.

9. Open-end spinning machine with a plurality of spinning stations located next to each other, each station having a respective spinning unit, comprising:

one collective drive adapted for collectively driving said spinning units; and a stationary auxiliary drive, which instead of said collective drive, can be associated with the spinning unit of each spinning station individually, wherein the direction of rotation of said auxiliary drive is reversible.

10. Spinning machine as in claim 1, wherein said auxiliary drive is adapted to be controlled from a control device located on a movable service unit adapted to be driven alongside said machine and said plurality of spinning stations thereof.

11. Spinning machine as in claim 10, further including a draw-off device for drawing off thread during a thread joining process, and an auxiliary drive device therefor, also adapted to be controlled by the service unit control device.

12. Open-end spinning machine with a plurality of spinning stations located next to each other, each station having a respective spinning unit, comprising:

one collective drive adapted for collectively driving said spinning units;

a stationary auxiliary drive, which instead of said collective drive, can be associated with the spinning unit of each spinning station individually; and, wherein said collective drive includes a main drive belt for driving a plurality of spinning elements simultaneously, and said auxiliary drive includes an auxiliary drive belt for driving a given spinning unit individually.

13. Spinning machine as in claim 12, wherein said auxiliary drive belt is narrower than said main drive belt.

14. Spinning machine as in claim 12, further including an individual switch-over device provided at each spinning station to alternately select application of one or the other of the two drives to the spinning unit for the respective spinning station, said machine further including an elastic element for acting on each respective switch-over device so that said main drive belt drivingly engages a driving element connected to the spinning element when that switch-over device is enabled.

15. Spinning machine as in claim 12, further including a two-armed switch-over lever for each respective spinning station, said lever being provided with a main clamping roller on one arm thereof for engaging said main belt and with an auxiliary clamping roller on the other arm thereof for engaging said auxiliary belt, said lever adapted to be actuated for alternate application of said main drive belt or of said auxiliary drive belt against a respective spinning unit.

16. Spinning machine as in claim 15, wherein said switch-over lever is controllably linked to a brake for each respective spinning unit.

17. Spinning machine as in claim 16, further including a brake lever supported by said switch-over lever, with said brake being located on said brake lever.

18. Spinning machine as in claim 17, wherein said brake lever is provided with at least one carrier, and further wherein movement of said brake lever from a neutral spinning position into its end position for braking lifts said main clamping roller away from said main drive belt, while its movement into its other end position for thread joining causes said auxiliary clamping roller to come into contact with said auxiliary drive belt.

19. Spinning machine as in claim 18, wherein said brake lever is pivotably supported by one of its ends on a shaft which supports said main clamping roller of said two-armed switch-over lever, while its free end is connected with an activating device, said brake lever being equipped with a braking surface between its two ends and being movable into its braking position in such a manner that said brake lever, after reaching its braking position and continuing its movement causes pivoting of said switch-over lever as a result of the application of said braking surface thereof upon said spinning unit.

20. Spinning machine as in claim 19, wherein said spinning unit is located in immediate proximity of said main clamping roller, and further wherein that the distance between the free, activating end of said brake lever and said braking surface which can be brought to bear upon said spinning unit is greater than the distance between said braking surface and said shaft supporting said main clamping roller.

21. Spinning machine as in claim 17, wherein said brake lever is equipped with an intermediate lever which is supported pivotably on a common shaft, together with said switch-over lever, whereby one end of said intermediate lever is in gearing contact with an activating device connected with a free end of said two-armed switch-over lever and overlaps said two-armed switch-over lever on its side away from a spinning unit while its other end is articulatedly linked to said brake lever, said brake lever reaching under said two-armed switch-over lever by means of a carrier on its side towards a spinning unit.

22. Spinning machine as in claim 16, further including a brake lever supported on bearings independently of said two-armed switch-over lever, equipped on both sides of a pivoting shaft of said two-armed switch-over lever with one carrier for each side to pivot said two-armed switch-over lever in one or the other pivoting direction as desired.

23. Spinning machine as in one of claims 17 or 22, wherein said spinning unit comprises a spinning rotor, with the shaft of said spinning rotor supported on bearings in a keyway formed by supporting discs, and wherein said brake lever is movable in the direction of said supporting discs for braking said spinning rotor shaft.

24. Spinning machine as in claim 23, wherein said spinning rotor shaft is supported by a single pair of supporting discs on a side thereof towards said spinning rotor, in relation to said main drive belt and to said auxiliary drive belt, while being supported by a combined axial/radial bearing on the side thereof opposite said spinning rotor.

25. Spinning machine as in claim 14, further including a service unit, movable alongside a plurality of the spinning stations, said service unit including a drive mechanism controllable by means of a control program for relatively activating each of said respective switch-over devices.

26. Open-end spinning machine with a plurality of spinning stations located next to each other, each station having a respective spinning unit, comprising:

one collective drive adapted for collectively driving said spinning units; and a stationary auxiliary drive, which instead of said collective drive, can be associated with the spinning unit of each spinning station individually; and further comprising a control lever for each respective spinning station for the attribution of either said collective drive or of said auxiliary drive to a respective spinning unit as desired, said control lever being pivotable in relation to a separate hinged cover covering each respective spinning station.

27. Spinning machine as in claim 26, wherein said control lever is adapted for selectively assuming one of three relative positions in relation to said cover, including a production position whereby it is flush with said cover, a braking position whereby it is swung away from said spinning station, and a third joining position whereby it is pushed into said cover.

28. Spinning machine as in claim 27, further including a locking device provided for said control lever.

29. Spinning machine as in claim 28, further including:

an elastic member for placing said locking device under elastic pressure in such manner that it allows movement of said control lever into said thread joining position, but prevents return thereof into said production position; and a controllable solenoid provided for control of said locking device.

30. Spinning machines in claim 29, wherein said solenoid is adapted to be controllably linked to a switching device which controls fiber feeding to said spinning unit.

31. Spinning machine as in one of claims 14 or 15, further including a damping device provided for said switch-over device.

32. Spinning machine as in claim 21, wherein said damping device includes a frictional damper.

33. Spinning machine as in claim 32, wherein said frictional damper is located in bearings of said switch-over device.

34. An open-end spinning machine having a plurality of spinning stations, comprising:

collective drive means adapted for driving said plurality of stations with one collective drive at a predetermined spinning speed;

stationary centralized auxiliary drive means adapted for driving selected ones of said plurality of stations at a predetermined thread-joining speed which is less than said spinning speed;

switch-over means, associated with each of said spinning stations, for selectively and independently powering each respective station either with said collective drive means or with said auxiliary drive means, whereby each station of said machine may be selectively driven at either said spinning speed or said thread-joining speed, the ratio between which two speeds may be universally established for all stations of said machine by desired operation of said auxiliary drive means relative said collective drive means; and damping means for reducing vibration in said switch-over means induced by the randon occurrence of imbalances in said spinning stations.

35. A machine as in claim 34, wherein said switch-over means further includes brake means for selectively removing application of either said two drive means from a given spinning station, while applying braking force thereto for ceasing rotation of such spinning station.

36. A machine as in claim 35, wherein said switch-over means including said brake means thereof are adapted to be manually actuated or actuated automatically by a mobile service unit servicing said machine, so as to selectively operate each respective spinning station for production operation, for thread joining operation, or for stopped operation.

37. A machine as in claim 34, wherein said ratio is selectively established generally in the range from about 95:100 to about 75:100.

38. An open-end spinning machine having a plurality of spinning stations, comprising:

collective drive means adapted for driving said plurality of stations with one collective drive at a predetermined spinning speed;

stationary centralized auxiliary drive means adapted for driving selected ones of said plurality of stations at a predetermined thread-joining speed which is less than said spinning speed; and switch-over means, associated with each of said spinning stations, for selectively and independently powering each respective station either with said collective drive means or with said auxiliary drive means, whereby each station of said machine may be selectively driven at either said spinning speed or said thread-joining speed, the ratio between which two speeds may be universally established for all stations of said machine by desired operation of said auxiliary drive means relative said collective drive means; wherein each of the spinning stations include respective spinning units with drive shafts;

said collective drive means and said auxiliary drive means includes a central main drive belt and a central auxiliary drive belt, respectively; and said switch-over means include a main clamping roller and an auxiliary clamping roller, mounted on opposite sides of a pivot point, for selectively applying respectively either of said main drive belt or said auxiliary drive belt to a given spinning unit drive shaft for rotatably driving such spinning unit.

39. A machine as in claim 38, wherein said spinning units comprise respective spinning rotors.

40. A process for joining thread at respective spinning stations of an open-end spinning machine, each such station including a respective spinning unit, said process comprising the steps of:

providing a collective main drive for selectively driving each of the spinning units simultaneously generally at a predetermined production speed;

providing a central auxiliary drive for selectively driving individual spinning units at a predetermined thread-joining speed, which is less than said production speed but relatively close thereto; and operating selected spinning stations for thread-joining, including driving the respective spinning units thereof at said thread-joining speed with said auxiliary drive while feeding fibers to such spinning units so as to achieve thread-joining, and subsequently drawing-off thread from such spinning units at said production speed with said main drive, whereby stronger and more reliable thread joins are produced in yarn of increased uniformity;

wherein said operating step further includes:

initially stopping the respective spinning unit of the selected spinning station;

temporarily driving such spinning unit with said main drive for accelerating such unit to a rotational speed about that of said predetermined thread-joining speed;

then switching driving of such spinning unit to said auxiliary drive so as to maintain the rotational speed thereof at said predetermined thread-joining speed throughout thread-joining operation; and thereafter upon completion of said thread-joining operation, returning driving of such spinning unit to said main drive for driving such unit at said production speed for the production of thread.

41. A process as in claim 40, wherein said second-recited providing step includes determining a thread-joining speed which is in the range of about 5% to 25% less than said production speed.

42. A process for joining thread at respective spinning stations of an open-end spinning machine, each such station including a respective spinning unit, said process comprising the steps of:

providing a collective main drive for selectively driving each of the spinning units simultaneously generally at a predetermined production speed;

providing a central auxiliary drive for selectively driving individual spinning units at a predetermined thread-joining speed, which is less than said production speed but relatively close thereto; and operating selected spinning stations for thread-joining, including driving the respective spinning units thereof at said thread-joining speed with said auxiliary drive while feeding fibers to such spinning units so as to achieved thread-joining, and subsequently drawing-off thread from such spinning units at said production speed with said main drive; whereby stronger and more reliable thread joins are produced in yarn of increased uniformity; wherein determining said thread-joining speed includes the step of determining such thread-joining speed in accordance with particular spinning conditions, such as given fiber material being spun or the diameter of the spinning units being used, independent from said production speed.

43. A process for joining thread at respective spinning stations of an open-end spinning machine, each such station including a respective spinning unit, said process comprising the steps of:

providing a collective main drive for selectively driving each of the spinning units simultaneously generally at a predetermined production speed;

providing a central auxiliary drive for selectively driving individual spinning units at a predetermined thread-joining speed, which is less than said production speed but relative close thereto; and operating selected spinning stations for thread-joining, including driving the respective spinning units thereof at said thread-joining speed with said auxiliary drive while feeding fibers to such spinning units so as to achieve thread-joining, and subsequently drawing-off thread from such spinning units at said production speed with said main drive; whereby stronger and more reliable thread joins are produced in yarn of increased uniformity; wherein said operating step includes the step of varying said thread-joining speed during driving of a spinning unit with said auxiliary drive so that the rotational speed of such spinning unit is accelerated generally in accordance with the amount of fibers reaching such spinning unit during a thread-joining operation.

44. An open-end spinning machine with a plurality of spinning stations located next to each other, each station have a respective spinning unit and corresponding fiber feeding means for feeding fiber thereto, comprising:

respective main and auxiliary driving means for said spinning units; and independent main and auxiliary drive shaft means for respectively being controlled and selected for respectively driving said fiber feeding means; and coupling change-over means for selecting one or the other of said independent drive shaft means for driving one of said fiber feeding means.

45. A machine as in claim 44, wherein the direction of rotation of said independent auxiliary drive shaft means is reversible.

* * * * *